US005336057A

United States Patent [19]

Fukuda et al.

[11] Patent Number: 5,336,057

[45] Date of Patent: Aug. 9, 1994

[54] MICROPUMP WITH LIQUID-ABSORPTIVE POLYMER GEL ACTUATOR

[75] Inventors: Toshio Fukuda, Nagoya; Shinobu Hattori; Shigenobu Nagamori, both of Kyoto, all of Japan

[73] Assignee: Nippon Densan Corporation, Kyoto, Japan

[21] Appl. No.: 94,253

[22] Filed: Jul. 20, 1993

Related U.S. Application Data

[62] Division of Ser. No. 954,310, Sep. 30, 1992, Pat. No. 5,288,214.

[30] Foreign Application Priority Data

Sep. 30, 1991 [JP] Japan ..... 3-280849
Oct. 8, 1991 [JP] Japan ..... 3-290861

[51] Int. Cl.[5] ..... F04B 45/00

[52] U.S. Cl. ..... 417/395; 604/892.1; 222/386.5; 222/395

[58] Field of Search ..... 604/890.1, 892.1; 417/395; 137/199, 197; 222/386.5, 394, 395

[56] References Cited

U.S. PATENT DOCUMENTS

| | | | |
|---|---|---|---|
| 4,111,201 | 9/1978 | Theeuwes | 222/395 X |
| 4,111,202 | 9/1978 | Theeuwes | 222/395 X |
| 4,111,203 | 9/1978 | Theeuwes | 222/395 X |
| 4,775,474 | 10/1988 | Chau et al. | 210/500.34 |
| 4,904,475 | 2/1990 | Gale et al. | 604/892.1 |
| 5,045,082 | 9/1991 | Ayer et al. | 604/892.1 |
| 5,122,128 | 6/1992 | Cardinal et al. | 604/890.1 |
| 5,135,523 | 8/1992 | Magruder et al. | 604/892.1 |

OTHER PUBLICATIONS

"Preliminary Investigation of Micropumping Based on Electrical Control of Interfacial Tension". pp. 105–110, Hirofumi Matsumoto et al. Apr. 1990 IEEE.

"Prototype Micro-Value Actuator" pp. 40–41, John D. Busch et al. Apr. 1990 IEEE.

"A Micro Chemical Analyzing System Integrated on a Silicon Wafer" pp. 89–94, Shigeru Nakagawa et al Apr. 1990 IEEE.

"Normally Close Microvalue and Micropump Fabricated on a Silicon Wafer", pp. 29–34, Masayoshi Esashi et al. Mar. 1989 IEEE.

"Fluid Flow in Micron and Submicron Size Channels" pp. 25–28, John Horley et al. Mar. 1989 IEEE.

"An Electrohydromatic Micropump" pp. 99–104, Axel Richter et al. Apr. 1990 IEEE.

"Micromachined Silicon Microvalue" pp. 95–98, T. Ohnstein et al. Apr. 1990 IEEE.

"A—Piezo-Electric Pump Driven by a Flexural Progressive Wave", pp. 283–288, Shun-ichi Miyazaki et al. Sep. 1991 IEEE.

*Primary Examiner*—Richard A. Bertsch
*Assistant Examiner*—Alfred Basichas

[57] ABSTRACT

A micropump comprises a pump body member for defining a tank chamber holding liquid, a liquid inlet portion, a liquid outlet portion for discharging the liquid medium in the tank chamber, a liquid outlet portion for discharging the liquid medium in the tank chamber, and an actuator for reducing a volume of the tank chamber. The actuator is formed of a liquid-absorptive polymer gel.

7 Claims, 3 Drawing Sheets

MICROPUMP WITH LIQUID-ABSORPTIVE POLYMER GEL ACTUATOR

This is a division of co-pending application Ser. No. 07/954,310 filed on Sep. 30, 1992, now U.S. Pat. No. 5,288,214.

BACKGROUND OF THE INVENTION

1. Field Of The Invention

The present invention relates to a micropump for supplying and feeding fluid at a low flow rate.

2. Description of the Prior Art

Recently, research into micro-electromechanical systems has become more active, and for example, several designs of micropumps have been proposed, including a chemical pump using electrically shrinking high molecules.

In the use of a conventional micropump of this kind, there are many problems to be solved, as described in the following;

(1) Construction is complex, (2) Minimizing to the required size is difficult, (3) Adequate and reliable opening and closing operations of the inlet flow passage and outlet flow passage is difficult, and so on.

SUMMARY OF THE INVENTION

A first object of the present invention is to enable a pump body to be sufficiently small, and moreover, to provide a micropump of excellent function, ensuring opening and closing operation of the flow passages.

A second object of the present invention is to provide a micropump which facilitates minimization, and negates the need for a special power supply.

According to the present invention, there is provided a micropump comprising a housing for defining a pump chamber, an inlet valve means disposed in an inlet flow passage connecting to the pump chamber, an outlet valve means disposed in an outlet flow passage connecting to the pump chamber, and an actuator for changing volume of the pump chamber. The inlet valve means and the outlet valve means are respectively comprised of a valve body defining a valve chamber, a blocking means disposed in the valve chamber, and a deviating means for deviating resiliently the blocking means in the direction for closing the flow passage. The actuator is formed of a thermo-responsive polymer gel material which decreases in volume as the actuator is being heated. The decreased volume of the actuator in turn increases the volume of the pump chamber reducing the pressure therein so as to draw the blocking means of the inlet valve means in a valve opening direction against an action of the deviating means of the inlet valve means. Thus, fluid flows into the pump chamber through the inlet flow passage. While the volume of the actuator increases subject to the actuator being cooled, a volume of the pump chamber decreases thereby increasing the pressure therein so as to move the blocking means of the outlet valve means in the opening direction against an action of the deviating means of the outlet valve means, resulting in the fluid being discharged from the pump chamber thorough the outlet flow passage.

In addition, according to the present invention, a micropump is provided comprising a pump body for defining a fluid-holding tank chamber, a fluid inlet portion mounted on the pump body, a fluid outlet portion mounted on the pump body for discharging fluid in the tank chamber, and an actuator for decreasing a volume of the tank chamber. The actuator is formed of a liquid-absorptive polymer gel material which increases in volume by absorbing fluid supplied to the actuator thorough the fluid inlet portion, thereby decreasing the volume of the tank chamber so as to discharge the fluid in the tank chamber through the fluid outlet portion.

The above and other objects, features and advantages of the present invention will become clear from the following description easily.

BRIEF DESCRIPTION OF THE DRAWINGS

FIG. 6-A and FIG. 6-B are brief descriptive drawings for explaining operations of the micropump shown in FIG. 5.

DETAILED DESCRIPTION OF THE PREFERRED EMBODIMENTS

The invention will be described in more detail with reference to the accompanying drawings, which show preferred embodiments of the present invention.

First Embodiment

A first embodiment of the micropump in accordance with the present invention will be described with reference to FIGS. 1 through 4.

Figure 1:
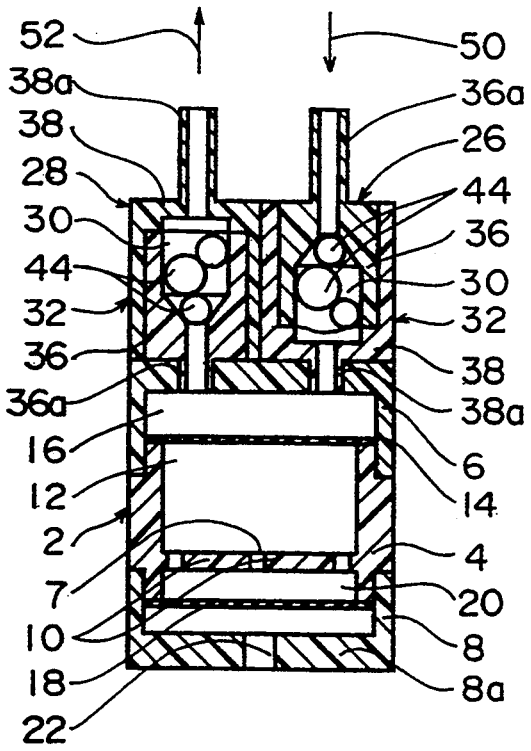
FIG. 1 is a sectional view of the first embodiment of the micro pump in accordance with the present invention.
Figure 2:
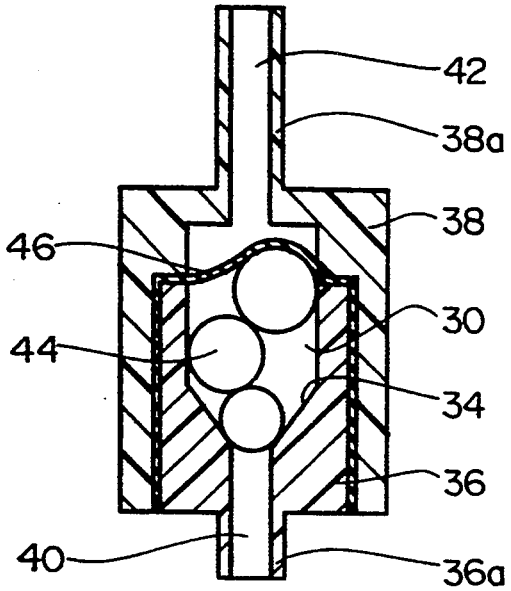
FIG. 2 is a fragmentally enlarged sectional view of a valve means of the micropump shown in FIG. 1.

Referring to FIG. 1, the micropump as illustrated has a housing 2 of nearly cylindrical shape in outside profile.

The size of housing 2, is, e.g., approximately 8 mm in diameter and 14.5 mm in length. The housing 2 has a mid-housing 4 of cylindrical shape, lower end-housing 8, and upper end-housing 6.

At the inside of one end (the lower end in FIG. 1) of mid-housing 4, a jointing wall 10 extends leftwardly and rightwardly in FIG. 1. The jointing wall 10 defines a plurality of holes 7, and adjacent such a jointing wall 10, a gel medium 12 is disposed for functioning as an actuator.

The gel medium 12 can be a thermo-responsive polymer material like polyvinyl methylether-type plastic.

Between the mid-housing 4 and the opposing upper end-housing 6, a thin sheet-like member 14 is mounted. The sheet-like member 14 can be fabricated from, e.g., synthetic rubber, to partly define a pump chamber 16 in cooperation with the end-housing 6.

This sheet-like member 14 is also affixed to the upper surface of the gel medium 12 which expands or shrinks along with expansion and shrinkage of the gel medium 12 as mentioned later.

Between the mid-housing 4 and the opposing lower end-housing 8, a thin sheet-like member 18 is mounted.

The sheet-like member 18 also can be fabricated from, e.g., synthetic rubber, to partly define a fluid-holding chamber 20 in cooperation with the mid-housing 4 and the jointing wall 10. The fluid holding chamber 20 contains a water-like fluid to be absorbed into the gel medium 12 when below a threshold temperature.

Figure 3:
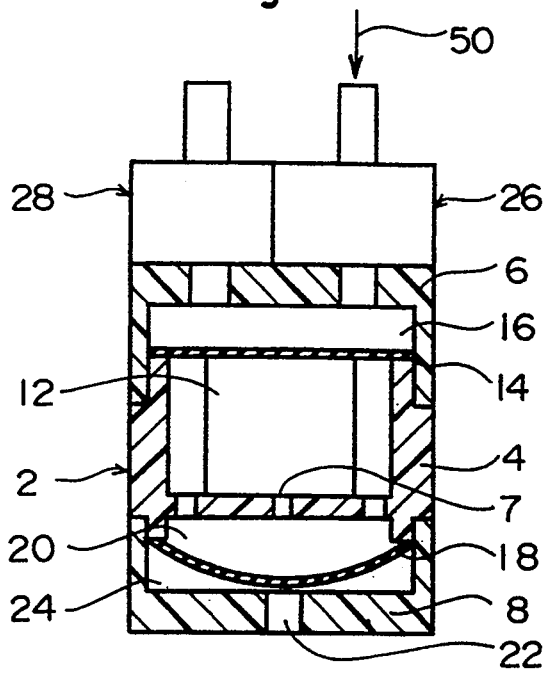
FIG. 3 and FIG. 4 are sectional views of the micropump shown in FIG. 1 for explaining the respective functions of a micropump.
Figure 4:
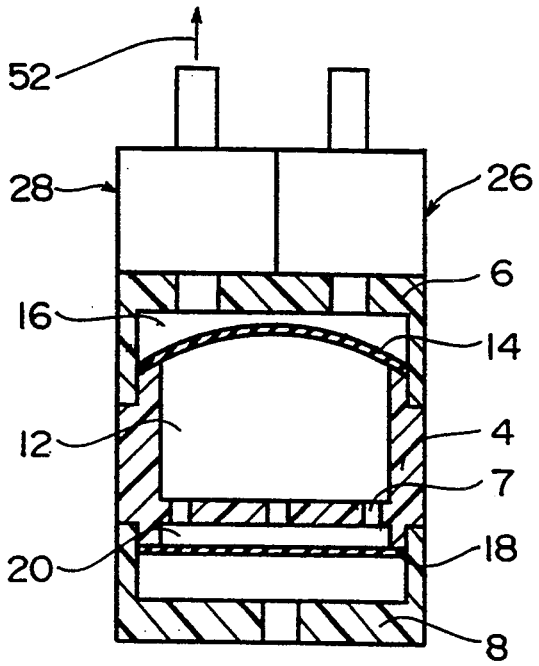

At an end-wall portion 8a of the lower end-housing 8, a through hole 22 is formed. The air in a space 24 is exhausted outwardly through the through hole 22, as shown in FIG. 3. On the other hand, when a sheet-like member 18 shrinks as shown in FIG. 4, the outside air flows into the space 24 through the through hole 22. Allowing air to enter and exit the space 24 ensures the expansion and shrinkage of the sheet-like member 18.

At the opposing upper end housing 6, an inlet valve means 26 and an outlet valve means 28 are mounted. The inlet valve means 26 and the outlet valve means 28 are substantially of the same construction, and description of the inlet valve means 26 will be made with regard to the outlet valve means 28 hereinafter, referring to FIG. 2.

A valve means 28 (26) has a valve body 32 for defining a valve chamber 30. The valve body 32 comprises a first member 36 defining the valve seat 34, and a second member 38 mounted to the first member 36 so as to define a valve chamber 30 by the first member 36 and the second member 38. The first member 36 defines a flow passage 40 extending downwardly from the valve seat 34. The second member 38 defines a flow passage 42 extending upwardly from the valve chamber 30.

The valve chamber 30 contains a blocking means. The blocking means comprises spherical members 44 of a high water-absorptive polymer gel material such as e.g., polyacrylic acid salt-base gel, and in the present embodiment, three spherical members 44 are arranged within the valve chamber 30. The spherical members 44 will swell to some extent by absorbing the fluid fed from the valve, resulting in resilience being ensured.

In addition, in cooperation with the blocking means, deviating means is disposed so as to deviate the blocking means towards a valve seat 34. The deviating means comprises a resilient membrane member 46 for being penetrated by the fluid supplied by a valve, and mounted between the first member 36 and the second member 38. Because such deviating means is provided generally, the blocking means, more specifically, the spherical member 44 adjacent to the valve seat 34 is squeezed resiliently against the valve seat 34 by pressure exerted from the deviating means so as to block a flow passage 40.

With regard to the inlet valve means 26, a connected projection 38a of the second member 38 is installed into a hole formed at the upper end-housing 6. Flow passages 40 and 42 of the inlet valve means 26 comprise an inlet flow passage with a blocking means disposed at such an inlet flow passage.

This blocking means blocks the inlet flow passage as a result of pressure exerted from a resilient membrane member 46. Further, with regard to the inlet valve means 26, a projection 36a of the first member 36 is connected to a fluid pressure source (not shown).

In addition, with regard to an outlet valve means 28, a connected projection 36a of the first member 36 is mounted into a hole formed at the upper end-housing 6. Consequently, flow passages 40 and 42 of the outlet valve means 28 comprise an outlet passage, at which a blocking means is contained, and the blocking means blocks an outlet flow passage, generally as a result of pressure exerted from the resilient membrane :member 46. Further, with regard to the outlet valve means 28, a projection 38a of the second member 38 is connected to the fluid supply side (not shown).

Referring mainly to FIG. 3 and FIG. 4, the operation of the micropump of the first embodiment will now be described.

The micropump illustrated supplies fluid from an inlet flow passage to an outlet flow passage by heating and cooling the gel medium 12. Namely, exceeding a transition temperature by heating the gel medium (not shown, by heating the gel medium 12, e.g., with Ni—Cr wire through a hole 7 of the jointing wall 10), water-like liquid as absorbed is extracted from the gel medium 12. This extracted liquid is held in the liquid holding chamber 20. Thus, as shown in FIG. 3, a sheet-like member 14 for defining a pump chamber 16 shrinks along with the gel medium 12, causing an increase of a volume of the pump chamber 16. Thus, in cooperation with the shrinking of the sheet-like member 14, the opposing sheet-like member 18 extends by pressure exerted from the extracted fluid filling the fluid holding chamber 20.

Thus, subject to the volumetric increase of the pump chamber 16, a corresponding decreasing pressure in the pump chamber 16 draws spherical members 44 of the inlet valve means 26 toward an opening direction against a resilient force of the resilient membrane member 46, thus resulting in fluid flowing into the pump chamber 16 through the inlet flow passage as shown with an arrow 50 (FIG. 1 and FIG. 3).

On the other hand, subject to gel medium 12 being cooled, (any one method is allowable from natural air cooling, or forced cooling), the gel medium 12 swells by absorbing the fluid in the fluid holding chamber 20 so as to extend sheet-like member 14 resulting in the volumetric decreasing of the pump chamber 16 as shown in FIG. 4. Thus, in cooperation with the fluid being absorbed into the gel medium 12, the opposing sheet-like member 18 shrinks.

Thus, subject to the volumetric increase of the gel medium 12, a correspondingly rising fluid pressure in the pump chamber 16 acts on spherical members 44 of the outlet valve means 28 so as to move the spherical members 44 in an opening direction against a resilient force of the resilient membrane member 46 so that the fluid in the pump chamber 16 is discharged through an outlet flow passage as illustrated with an arrow 52 (FIG. 1 and FIG. 4).

Therefore, it is possible to supply fluid as required by heating and cooling the gel medium 12 continuously, and to control the supply volume of the fluid by changing the cycles for heating and cooling.

Second Embodiment

A description will now be given of a second embodiment of the micropump of the present invention, with specific reference to FIG. 5 and FIG. 6.

Figure 5:
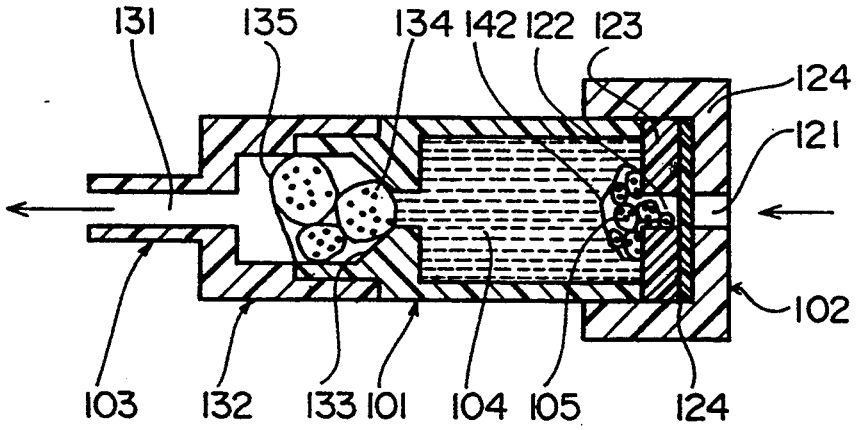
FIG. 5 is a sectional view for showing a second embodiment of the micropump in accordance with the present invention.
Figure 5:
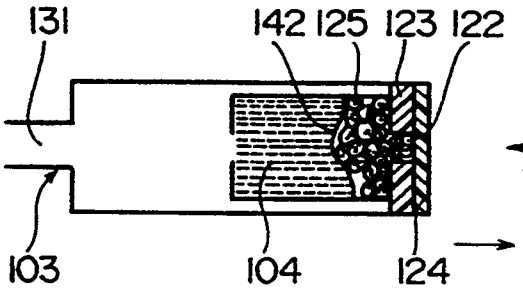
Figure 5:
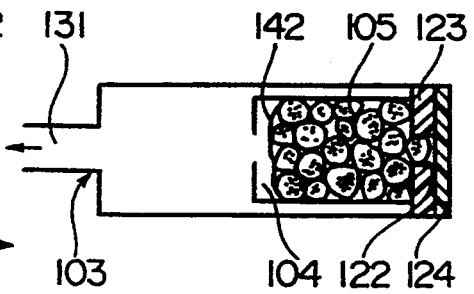

Referring to FIG. 5, the micropump illustrated has a pump body of a cylindrical shape 101, a fluid inlet portion 102 mounted at the side of the pump body 101, a fluid outlet portion 103 mounted at the other side, a tank chamber 104 set in the pump body 101, and an actuator 105 disposed between a fluid inlet portion 102 and a tank chamber 104.

The fluid inlet portion 102 comprises an inlet housing 125 provided with an inlet port 121, an inlet cover 123 provided with an inlet port 122, a semi-permeable membrane 124 disposed between an inlet port 121 and an inlet cover 123.

The semi-permeable membrane 124 (e.g., a cellulose-type is allowable) has many supermicro-holes. The size of a hole is larger than that of a water molecule being a solvent of the solution to be supplied through the inlet port 121, but smaller than that of a solute molecule.

The fluid outlet portion 103 is comprised of an outlet valve means 132 having a valve-like outlet port 131. The valve means 132 has a sealing stop ball 134 acting on a valve seat 133 formed as a tapered configuration. The sealing stop ball 134 is forced against the valve seat 133 by pressure exerted from a resilient sheet 135 (constituting a deviating means). Such a resilient sheet 135 has permeability for the passing through of hormone liquid as described later. In the forward flow direction, a sealing stop ball 134 is pushed outwardly away from the valve seat 133 by a flow-out pressure and against a resilient force of the resilient sheet 135 so that the valve means 132 is in an open-flow state.

When the liquid flows reverses, the sealing stop ball 134 tightly contacts with the valve seat 133 so that the valve means 132 is in a closed-flow state. Thus, the fluid in the tank chamber 104 is ensured a one-directional, outward flow only. In addition, a water-absorptive polymer gel is used for the sealing stop ball 134. For instance, a polyacrylic acid salt-base gel is preferred so as to provide a just fittable resilience.

The tank chamber 104 is filled with a hormone liquid, e.g., insulin, etc. At the actuator 105, it is preferable to use a water-absorptive polymer gel (e.g., polyacrylic acid salt-base gel medium is applicable), and to be initialized in a condition almost free of water absorption.

Further, a very soft, thin membrane member of little rigidity 142, such as rubber, is employed for isolating the hormone liquid in the tank chamber 104 from that within the water-absorptive polymer gel so that the liquids in the chamber and the gel are never substantially mixed together.

The micropump operates as hereinafter described. A large concentration difference is permitted to exist between that of the solution within the tank chamber 104 of the micropump, and that of the solution contained in the water-absorptive polymer gel of the polymer actuator 105 in the micropump. Compared to the concentration of the external solution (the solution supplied and fed to the fluid inlet portion 102), the internal solution (the solution contained in the polymer gel) is controlled to be more concentrated, resulting in osmotic pressure being generated between these external and internal solutions through the semi-permeable membrane 124. Accordingly, the solvent (water) in the external solution flows into the micropump by penetrating the semi-permeable membrane 124. By this flow-in water, an actuator 105, e.g., a water-absorptive polymer gel swells, and increases the volume thereof from that of several factors of ten to that of several factors of a hundred. The swelling water absorptive polymer gel decreases a volume of the tank chamber 104, and the hormone liquid contained therein is discharged from the outlet port 131 through an outlet valve means 132 of the fluid outlet portion 103. (Refer to FIG. 6-A, and FIG. 6-B).

This micropump is for discharging liquid such as an internally filled hormone liquid, etc., outward gradually, and upon completing liquid discharge, the role thereof ends.

Although the invention has been described through its preferred forms with regard to the embodiment of a micropump, it is to be understood that described embodiments are not exclusive and various changes and modifications may be imparted thereto without departing from the scope of the invention which is limited solely by the appended claims.

For example, in the first embodiment as illustrated, the blocking means comprises three spherical members, but one, two, four, or more spherical members also are applicable.

What is claimed is:

1. A micropump for supplying and feeding fluid comprising:

a pump body member defining a tank chamber to contain fluid;

a fluid inlet portion mounted on said pump body member for receiving a fluid to be contained in said tank chamber;

a fluid outlet portion including an outlet port mounted on said pump body member for discharging fluid contained in said tank chamber;

an actuator for decreasing a volume of the tank chamber to discharge fluid contained in said tank chamber, said actuator comprising a liquid-absorptive polymer gel which increases in volume by absorbing a fluid supplied to said actuator from said fluid inlet portion, wherein the increase in volume of the actuator results in a decrease in volume of the tank chamber so as to discharge fluid in the tank chamber through said fluid outlet portion;

an outlet valve means disposed between said tank chamber and said fluid outlet portion, said outlet valve means comprising a plurality of sealing means formed of a liquid-absorptive polymer gel for opening and closing said outlet port; and a deviating means disposed between said sealing means and said outlet portion for deviating said sealing means to a closing direction.

2. A micropump according to claim 1, wherein said actuator is disposed between said fluid inlet portion and said tank chamber; and a semi-permeable membrane is disposed between said actuator and said fluid inlet portion for being substantially penetrated only by a solvent of a fluid supplied from said fluid inlet portion, said solvent being supplied to said actuator from said fluid inlet portion by means of osmotic pressure caused by a concentration difference between fluid contained in said actuator and fluid supplied from said fluid inlet portion.

3. A micropump according to claim 1, wherein said actuator is a polyacrylic acid salt-base gel.

4. A micropump according to claim 1, wherein said plurality of sealing means of said outlet valve means is a polyacrylic acid salt-base gel.

5. A micropump according to claim 1, wherein said deviating means is a resilient membrane member for being penetrated by a fluid.

6. A micropump according to claim 1, wherein said semi-permeable membrane includes a cellulose-type membrane member.

7. A micropump according to claim 1, wherein the fluid contained in said tank chamber is a hormone liquid.

* * * * *

UNITED STATES PATENT AND TRADEMARK OFFICE

CERTIFICATE OF CORRECTION

PATENT NO. : 5,336,057

DATED : August 9, 1994

INVENTOR(S) : Toshio Fukuda et al.

It is certified that error appears in the above-identified patent and that said Letters Patent is hereby corrected as shown below:

On the title page, item [73], Assignee--Toshio Fukuda--.

Signed and Sealed this

Sixteenth Day of May, 1995

*Attest:*

Bruce Lehman

BRUCE LEHMAN

*Attesting Officer*

*Commissioner of Patents and Trademarks*